US008330393B2

(12) United States Patent
Thomson et al.

(10) Patent No.: US 8,330,393 B2
(45) Date of Patent: Dec. 11, 2012

(54) SYSTEM FOR TIME-SEQUENTIAL LED-STRING EXCITATION

(75) Inventors: David Thomson, Fremont, CA (US); Ranajit Ghoman, Santa Clara, CA (US); Alan Li, Redwood City, CA (US)

(73) Assignee: Analog Devices, Inc., Norwood, MA (US)

( * ) Notice: Subject to any disclaimer, the term of this patent is extended or adjusted under 35 U.S.C. 154(b) by 429 days.

(21) Appl. No.: 12/148,755

(22) Filed: Apr. 21, 2008

(65) Prior Publication Data

US 2009/0079363 A1 Mar. 26, 2009

Related U.S. Application Data

(60) Provisional application No. 60/925,509, filed on Apr. 20, 2007.

(51) Int. Cl.
*G05F 1/00* (2006.01)

(52) U.S. Cl. ..... 315/308; 315/307; 315/209 R; 315/312

(58) Field of Classification Search ..... 315/291, 315/307, 308, 209 R, 312, 313, 323, 320, 315/299, 210, 226, 362, 361
See application file for complete search history.

(56) References Cited

U.S. PATENT DOCUMENTS

| | | | | |
|---|---|---|---|---|
| 4,285,009 | A | 8/1981 | Klopsch | 358/76 |
| 4,963,978 | A | 10/1990 | Ueda et al. | 358/29 |
| 5,153,926 | A | 10/1992 | Jansson et al. | 382/54 |
| 6,095,661 | A | 8/2000 | Lebens et al. | 362/184 |
| 6,305,818 | B1 | 10/2001 | Lebens et al. | 362/184 |
| 6,411,046 | B1 | 6/2002 | Muthu | 315/309 |
| 6,439,731 | B1 | 8/2002 | Johnson et al. | 362/29 |
| 6,498,440 | B2 * | 12/2002 | Stam et al. | 315/291 |

(Continued)

FOREIGN PATENT DOCUMENTS

WO WO 2004097783 A1 11/2004

OTHER PUBLICATIONS

"Report: LED Backlights to Proliferate in LCDs"; The World's Leading Microwave and RF event; EE Times: Latest News; IMS 2009; Boston, MA; [online]; [retrieved on Apr. 29, 2009]; Retrieved from the Internet: URL:http://www.eetimes.com/news/latest/showArticle.jhtml;jsessionid; 1 pp.

*Primary Examiner* — Douglas W Owens
*Assistant Examiner* — Jianzi Chen
(74) *Attorney, Agent, or Firm* — Koppel, Patrick, Heybl & Philpott

(57) ABSTRACT

A system for time-sequential LED-string excitation includes a controller coupled to at least two LED strings and arranged to sequentially excite the strings—preferably by pulse-width modulating their respective currents—such that each string conducts a desired current and/or provides a desired light intensity. Individual string currents and/or light intensities are provided to the controller as feedback signals. The controller preferably pulse-width modulates each string such that it conducts a current which approximates the performance that would be provided if the string were made to continuously conduct an 'optimal' current. A voltage converter may be included to provide the supply voltage connected to the top of each LED string, and to adjust the supply voltage as needed to ensure that each string conducts a desired current.

24 Claims, 3 Drawing Sheets

U.S. PATENT DOCUMENTS

| | | | | |
|---|---|---|---|---|
| 6,507,159 | B2 | 1/2003 | Muthu | 315/307 |
| 6,510,995 | B2 | 1/2003 | Muthu et al. | 235/454 |
| 6,552,495 | B1 | 4/2003 | Chang | 315/169.3 |
| 6,618,031 | B1 * | 9/2003 | Bohn et al. | 345/83 |
| 6,630,801 | B2 | 10/2003 | Schuurmans | 315/307 |
| 6,741,351 | B2 | 5/2004 | Marshall et al. | 356/406 |
| 6,768,525 | B2 | 7/2004 | Paolini et al. | 349/65 |
| 6,858,993 | B2 * | 2/2005 | Lee et al. | 315/185 S |
| 6,894,442 | B1 | 5/2005 | Lim et al. | 315/291 |
| 2003/0076056 | A1 | 4/2003 | Schuurmans | |
| 2003/0111533 | A1 | 6/2003 | Chang | |

* cited by examiner

SYSTEM FOR TIME-SEQUENTIAL LED-STRING EXCITATION

RELATED APPLICATIONS

This application claims the benefit of provisional patent application No. 60/925,509 to Ghoman et al., filed Apr. 20, 2007.

BACKGROUND OF THE INVENTION

1. Field of the Invention

This invention relates generally to systems for exciting a string of light-emitting diodes (LEDs), and more particularly to systems which excite multiple LED strings.

2. Description of the Related Art

LEDs are increasingly used for the purpose of providing illumination. For example, displays made from an array of liquid crystal devices (LCDs) require backlighting. This backlighting may be provided with multiple 'strings' of LEDs, with each string consisting of a number of LEDs connected in series.

Conventionally, LCD display backlighting is provided by exciting all of the LED strings simultaneously. Typically, the currents conducted by the strings are pulse-width modulated with a common waveform provided by an external circuit which adjusts the duty ratio as needed to obtain a desired intensity.

However, when so arranged, it is difficult to control the intensity of the light produced by individual strings, or to determine the locations of open or short circuit conditions that may exist within an individual string.

SUMMARY OF THE INVENTION

A system for time-sequential LED-string excitation is presented which overcomes the problems identified above, in that the system enables individual control of multiple LED strings, and makes it possible to pinpoint the location of open or short circuit conditions that may exist within individual strings.

The present system includes a single controller adapted to be coupled to at least two LED strings, each of which includes at least one LED. The controller is arranged to time-sequentially excite the LED strings one at a time such that each string conducts a desired current and/or provides a desired light intensity.

A system in accordance with the present invention preferably includes at least one light intensity sensor which produces an output that varies with the intensity of the light produced by at least one of the LED strings. The intensity sensor output(s) are provided as feedback to the controller, and enable the controller to time-sequentially excite the LED strings as needed to achieve desired light intensities from each string, preferably by pulse-width modulating their respective currents.

The strings may contain LEDs that are all the same color, such as white, or different strings may contain different colored LEDs. For example, a system may include three strings, containing red, blue and green LEDs, respectively.

Typically, a given LED string has an associated "optimal" current. In one embodiment, the system controller is arranged to excite each LED string such that it conducts an average current which is equal or proportional to its optimal current. For a system comprising x LED strings, the controller is preferably arranged to pulse-width modulate the current conducted by each LED string with a duty ratio of between 0 and 100/x %, and such that each string conducts an average current which is equal or proportional to x times its optimal current. For example, assume a system which includes three LED strings, with each string pulse-width modulated with a duty ratio of 20%. The system is arranged such that, when conducting, each string is made to conduct an average current which is equal or proportional to 5 times its optimal current.

The system may also include a voltage converter arranged to generate the supply voltage connected to the top of each LED string, and to adjust the supply voltage as needed to ensure that each string, when selected, conducts a desired current. The system may also be arranged to ensure that each string conducts a nominal non-zero current during the 'off' portion of its duty cycle. This minimizes the supply voltage changes which result from pulse-width modulation of the LED strings and greatly simplifies the design of the voltage converter. For example, a nominal non-zero current of a few microamps can typically be chosen and the light intensity produced by LEDs could be below the perceivable level.

These and other features, aspects, and advantages of the present invention will become better understood with reference to the following drawings, description, and claims.

DETAILED DESCRIPTION OF THE INVENTION

The present invention uses a controller to time-sequentially drive two or more strings of LEDs. When properly arranged, a system per the present invention enables individual string failures (opens or shorts) to be detected, allows the light intensities produced by multiple strings to be matched, or to be produced in desired ratios, and enables desired currents to be conducted in individual strings. It can be used to drive strings having LEDs of the same color, or of different colors: for example, three strings consisting of red, green and blue LEDs, respectively, could be driven so as to produce a resulting light that is essentially white. Such an arrangement might be well-suited to providing backlighting for an LCD display.

Figure 1A:
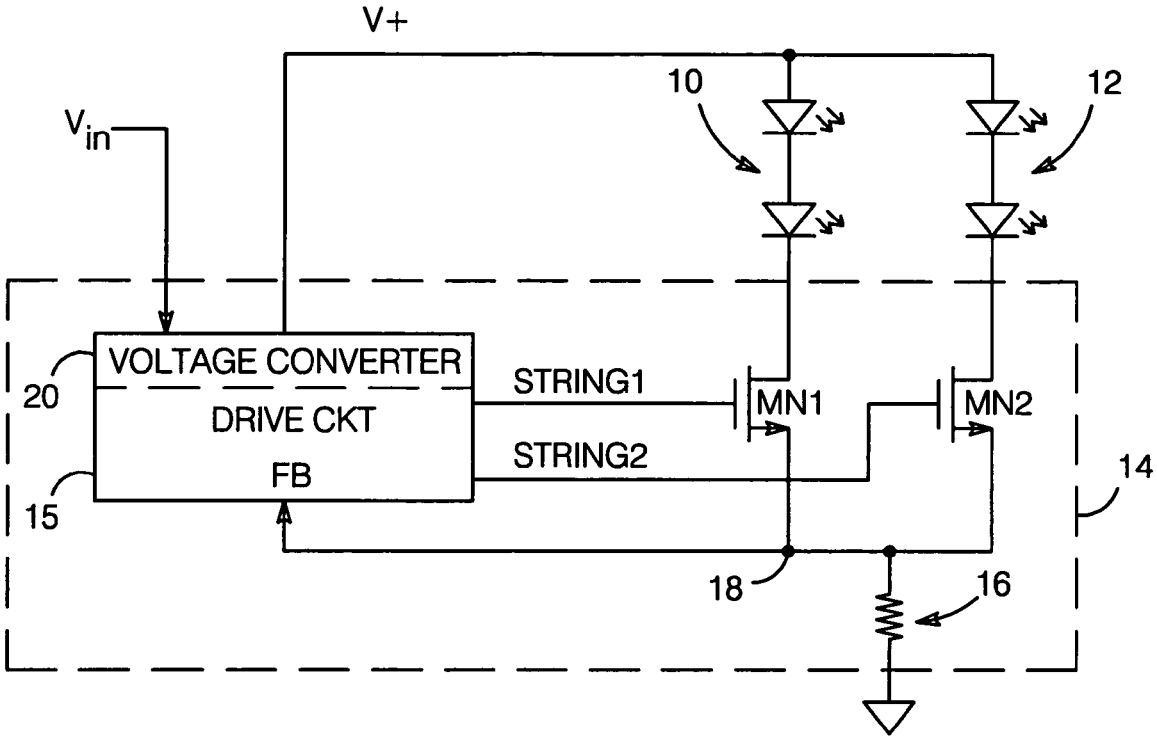
FIG. 1*a* is a block/schematic diagram illustrating the principles of a time-sequential LED-string excitation system per the present invention.
Figure 1B:
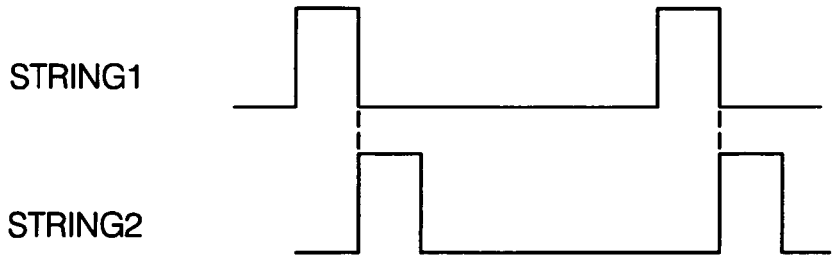
FIG. 1*b* is a timing diagram which illustrates the operation of the system of FIG. 1*a*.

The basic principles of a system for time-sequential LED-string excitation are illustrated in FIGS. 1*a* and 1*b*. In this example, there are two LED strings 10, 12, each consisting of two LEDs connected in series. The LED strings are connected between a supply voltage V+ and a controller 14. The controller is arranged to time-sequentially excite the LED strings such that each string conducts a desired current. This requires the controller to be capable of monitoring the current conducted by each individual string, and of independently adjusting each string's current as needed.

Time-sequentially exciting the LED strings in this way provides several benefits. By monitoring the current conducted by each string, individual string failures, such as an open or short circuit, can be detected, since a string with an open circuit will conduct no current and a string with a short circuit will conduct an excessively high current. In addition, having the capability to monitor and independently adjust each string's current enables the system to, for example, match the currents conducted or the light intensities produced by the two strings, or to cause the currents conducted or intensities produced by the two strings to be in a desired ratio to each other. This capability also provides a means to adjust the relative light intensities over time, to compensate for different rates of degradation for different types of LEDs. For example, different colored LEDs usually have different degradation or color-shifting characteristics.

The current in each string can be controlled in a variety of ways. One method is shown in FIG. 1*a*, in which switching transistors MN1 and MN2 are connected in series with respective strings, and operated with respective control signals STRING1 and STRING2 provided by a drive circuit 15. When operated as shown in FIG. 1*b*, MN1 is turned on first by STRING1, causing current to flow in string 10, followed sequentially by turning off MN1 and turning on MN2 with STRING2, causing current to flow in string 12. The current conducted by strings 10 and 12 varies with the amount of time MN1 and MN2 are on, and thus by the width of the STRING1 and STRING2 turn-on pulses. With the currents conducted by each string pulse-width modulated in this way, the current conducted by strings 10 and 12 varies with the duty cycles of control signals STRING1 and STRING2, respectively.

There is an 'optimal' current at which an LED operates at maximum optical efficiency; thus, assuming that the LEDs in a given string are all the same type, there will be an optimal current for each LED string. However, it is difficult to provide linear control of the string current to achieve the optimal current or a desired light intensity. As such, pulse-width modulating the string currents to achieve a desired current is preferred.

One way in which the current conducted by each string can be monitored is with the use of a current sense resistor 16 as shown in FIG. 1*a*. Here, the source terminals of MN1 and MN2 are connected together at a common node 18, and current sense resistor 16 is connected between node 18 and ground or a second supply voltage. Since the LED strings are excited sequentially, resistor 16 conducts the current conducted by the one string being excited at any given time. The resulting voltage developed at node 18 is provided to drive circuit 15 as a current sense feedback signal. In this way, controller 14 monitors the current conducted by each string, and modulates the string currents as needed to achieve a desired current. Producing a modulating signal in response to a current sense feedback signal as described above can be accomplished using a variety of techniques well-known to those familiar with closed loop feedback circuits of this sort.

Controller 14 may also include a voltage converter 20 arranged to generate the supply voltage V+ provided to the top of each LED string. In this case, converter 20 could also receive a feedback signal which varies with the voltage at node 18, and could be arranged to vary V+ and thereby vary the currents conducted by the LED strings so as to achieve a desired voltage at current sense feedback node 18. Thus, the currents conducted by the LED strings can be varied by means of pulse-width modulation, by varying V+, or by a combination of both. Voltage converter 20 would typically receive an input voltage $V_{in}$ and provide V+ as an output. Converter 20 could be a boost converter, a buck converter, or a linear converter as needed for a given application.

Note that, in practice, switching transistors MN1 and MN2, as well as voltage converter 20, may be packaged separately from drive circuit 15; for example, drive circuit 15 may be contained within one integrated circuit, voltage converter 20 contained within a second IC, and switching transistors MN1 and MN2 may be discrete, external devices. This is also applicable to the embodiments discussed below.

Also note that controller 14 can be arranged to turn off the switching transistors upon detection of one or more malfunctions. For example, the controller can be arranged to detect when one or more of the string currents exceeds a predetermined threshold, and to turn off MN1 and/or MN2 in response. Similarly, MN1 and MN2 can be turned off if an overvoltage condition is detected on the common voltage rail (V+).

Figure 2A:
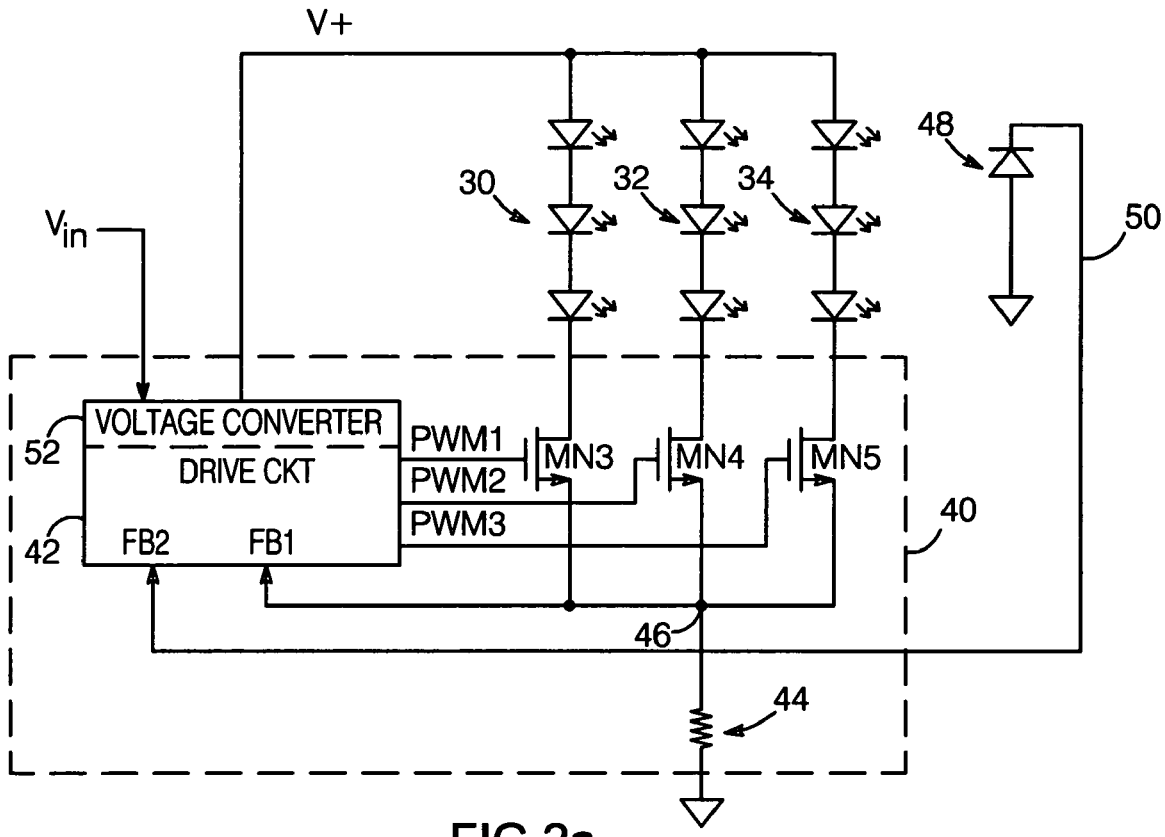
FIG. 2*a* is block/schematic diagram of another embodiment of a time-sequential LED-string excitation system per the present invention.

Another possible embodiment of a system in accordance with the present invention is shown in FIG. 2*a*. Here, there are three LED strings 30, 32, 34. All three strings may contain the same type and color of LED, such as all white LEDs, or the strings may contain different types and/or colors. For example, LED string 30 may contain red LEDs, while strings 32 and 34 contain green and blue LEDs, respectively. As noted above, red, green and blue LED strings can be driven so as to produce a resulting light that is essentially white, as might be needed for an LCD display backlighting application. Alternatively, the 3 strings could be driven so as to produce their respective colors in specific ratios, such that the resulting light has a desired color.

A controller 40 time-sequentially excites each LED string such that each string conducts a desired current. As discussed above, controller 40 is capable of monitoring the current conducted by each individual string, and of independently adjusting each string's current as needed. The string currents are preferably adjusted using pulse-width modulation, provided, for example, by connecting NMOS FETs MN3, MN4 and MN5 in series with strings 30, 32 and 34, and using a drive circuit 42 to switch the FETs on and off via drive signals PWM1, PWM2 and PWM3, respectively.

The string currents may be monitored by, for example, connecting the first terminal of a sense resistor 44 to a node 46 common to the sources of MN3, MN4 and MN5, and connecting the resistor's second terminal to ground or a second supply voltage. The voltage developed at node 46 varies with the current in the LED string being excited, and thus serves as a current sense feedback signal for controller 40.

Feedback to controller 40 might also take the form of a photosensor 48 which produces an output 50 that varies with the intensity of the light impinging on it. When so arranged, controller 40 can be arranged to vary the pulse-width modulated duty-cycle as needed to achieve a certain light intensity as detected by photosensor 48. Controller 40 may use one or both of the feedback signals to control the duty cycle.

As described above, controller 40 can also include a voltage converter 52 arranged to generate supply voltage V+provided to the top of each LED string. In this case, controller 40 may be arranged to vary the current conducted by the LED strings by varying V+ so as to achieve a desired voltage at current sense feedback node 46, and/or a desired light intensity as detected by photosensor 48. Thus, the current conducted and the light intensities produced by the LED strings can be varied by means of pulse-width modulation, by varying V+, or by a combination of both.

Figure 2B:
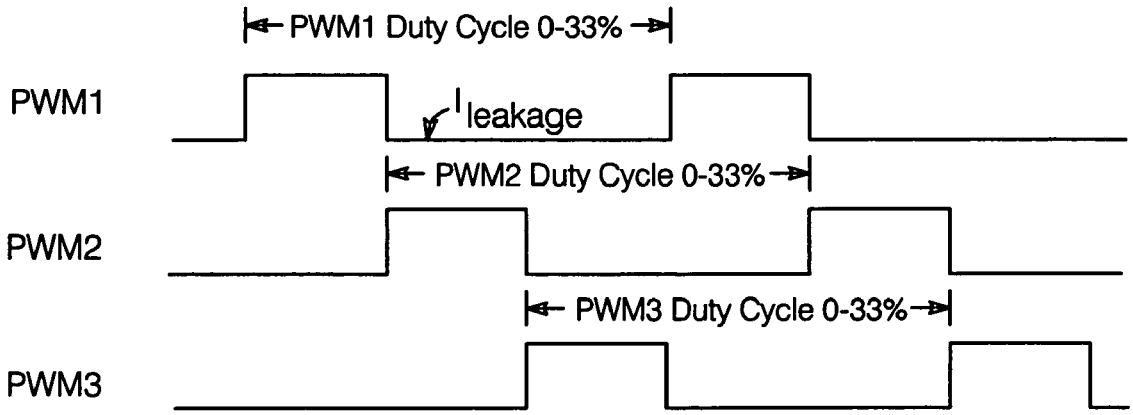
FIG. 2*b* is a timing diagram which illustrates the operation of the system of FIG. 2*a*.

An example of a method by which the LED strings of FIG. 2*a* can be pulse-width modulated is illustrated in FIG. 2*b*. In general, with x LED strings, the controller is preferably arranged to pulse-width modulate the current conducted by each LED string with a duty ratio of between 0 and 100/x %. Thus, with 3 LED strings, each string would sequentially be driven with a duty cycle D of 0-33%. Then, to cause each string to conduct the 'optimal' current, the string is driven to conduct a current given by 1/D times the optimal current. Thus, if LED string 30 is being driven with a duty cycle D of 20%, the average current through the string should be made equal to 1/0.20=5 times the optimal current to achieve maximum optical efficiency. This method permits the use of a single voltage converter, a common V+ rail for the parallel LED strings, and a single current sense resistor and amplifier (not shown).

During the 'off' portion of an LED string's duty cycle, the controller preferably causes the string to conduct a nominal non-zero current $I_{leakage}$ sufficient to keep the current sense feedback loop active, but below the level of normal light perception. This minimizes the supply voltage changes which result from pulse-width modulation of the LED strings, and greatly simplifies the design of the voltage converter. For example, an $I_{leakage}$ value of a few microamps ensures that the voltage controller does not have to switch all the way down to zero volts during the 'off' portion of an LED string's duty cycle, while still keeping the light intensity produced by the LEDs below the perceivable level.

Ideally, driving an LED string at a multiple of the optimal current as described above will result in the string delivering the same light intensity, as well as the same thermal characteristics and reliability, as if it were continuously driven to conduct the optimal current. In practice, it is possible that a scaling factor may be necessary to accomplish this; for example, in the example above, the current at a 20% duty cycle may need to be significantly greater than 5× the optimal current to get the same light efficiency. There may also be some reliability tradeoffs if, for example, electromigration is the dominant failure mechanism. Therefore, in practice, it may be necessary to arrange the system controller to excite each LED string such that it conducts an average current which is proportional to its optimal current, rather than strictly equal to 1/D times the optimal current.

Figure 3:
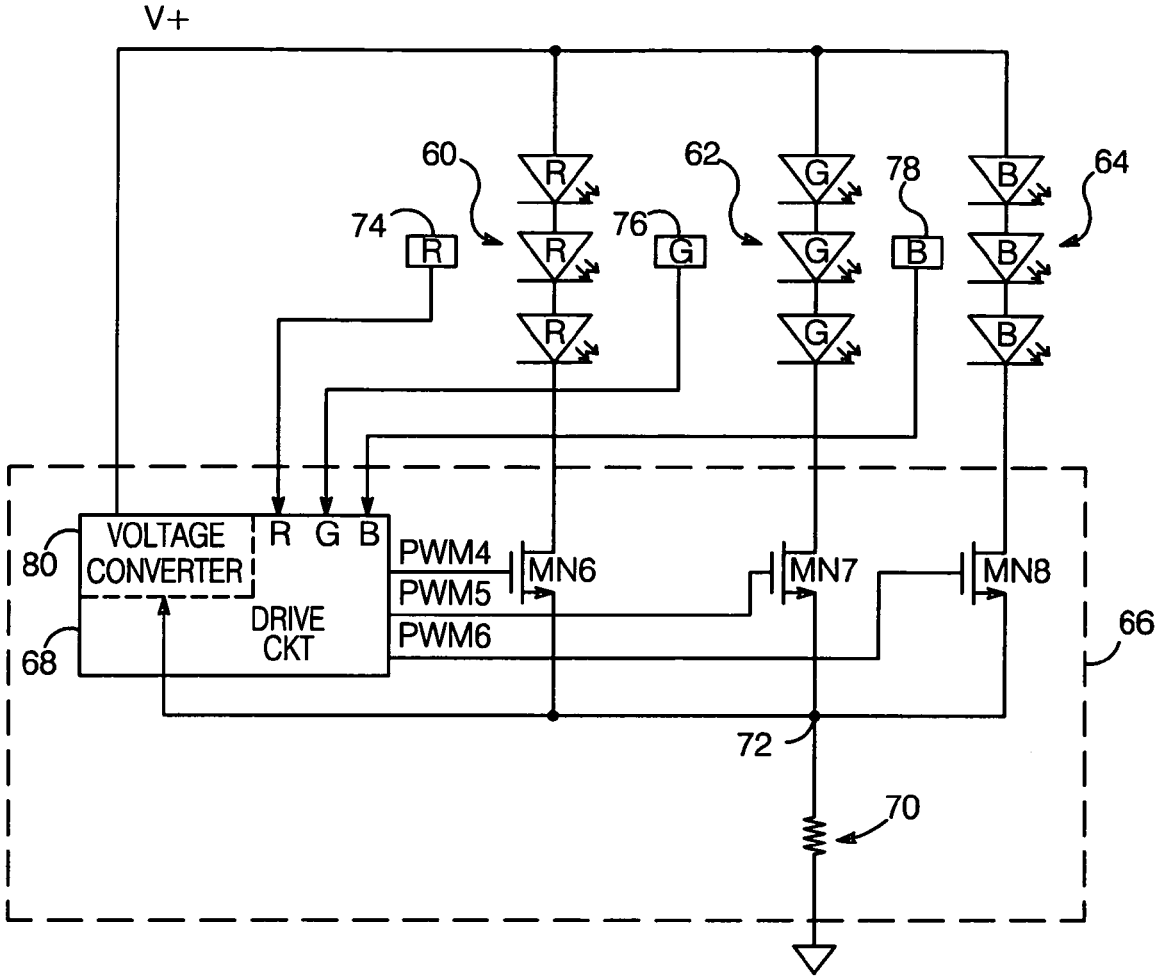
FIG. 3 is block/schematic diagram of another embodiment of a time-sequential LED-string excitation system per the present invention.

Another possible embodiment of a system in accordance with the present invention is shown in FIG. 3. Here, three LED strings 60, 62, 64 contain red, green and blue LEDs, respectively. A controller 66 time-sequentially excites each LED string such that each string conducts a desired current, with the controller capable of monitoring the current conducted by each individual string, and of independently adjusting each string's current as needed. The string currents are preferably adjusted using pulse-width modulation, provided, for example, by connecting NMOS FETs MN6, MN7 and MN8 in series with strings 60, 62 and 64, and using a drive circuit 68 to switch the FETs on and off via drive signals PWM4, PWM5 and PWM6, respectively.

To monitor the string currents, the first terminal of a sense resistor 70 is connected to a node 72 common to the sources of MN6, MN7 and MN8, with the resistor's second terminal connected to ground or a second supply voltage. The voltage developed at node 72 varies with the current in the LED string being excited, and thus serves as a current sense feedback signal for controller 66.

Here, rather than a single photosensor as in FIG. 2*a*, the embodiment of FIG. 3 uses three light intensity sensors 74, 76, 78, each of which produces an output which varies with the intensity of the light output produced by a respective one of the LED strings over a specified range of wavelengths. For example, sensor 74 is made specifically sensitive to red color wavelengths between 590 nm to 720 nm; i.e., sensor 74 measures the intensity of the light impinging on it that is within that range. Similarly, sensors 76 and 78 are made sensitive to green and blue color wavelengths, respectively.

The output of sensors 74, 76, 78 are provided to controller 66 as feedback signals. When so arranged, controller 66 can be arranged to control the red, blue and green LED strings so that they produce light equally such that the resulting light is white. Using feedback from the color sensors in this way, the red, blue and green LED strings can be made to produce white light that is constant in both color and intensity, which is particularly important when used in an LCD display backlight system. Another option may be to provide a user the ability to adjust the backlight color for his/her taste. Alternatively, as noted above, the 3 strings could be driven so as to produce their respective colors in specific ratios, such that the resulting light has a desired color. This method of color calibration for a display is important from a power efficiency standpoint; prior art techniques filter and suppress the background light intensity by adjusting liquid crystal characteristics.

Controller 66 may also include a color control algorithm processor, arranged to receive data representing the outputs of sensors 74, 76 and 78, and to cause the switching transistors to operate such that the resulting light is maintained as a desired color. A typical color control algorithm requires the performance of real-time multiple-input multiple-output inverse-matrix computations. Before a color control algorithm can be implemented, it is generally necessary to perform a one-time matrix calibration.

It is preferred, but not essential, that a system in accordance with the present invention employ color-specific sensors as described above. Using a set of color-specific sensors may also be useful when performing an initial calibration.

As above, controller 66 can also include a voltage converter 80 arranged to generate supply voltage V+ provided to the top of each LED string. Controller 66 may be arranged to vary the current conducted by the LED strings by varying V+so as to achieve a desired voltage at current sense feedback node 72 and/or desired light intensities as detected by sensors 74, 76 and/or 78. Thus, the current conducted by the LED strings can be varied by means of pulse-width modulation, by varying V+, or by a combination of both.

In this exemplary embodiment, the current sense feedback signal from node 72 is provided directly to voltage converter 80, while the feedback from sensors 74, 76 and 78 is provided to drive circuit 68. When so arranged, the voltage converter can be used to adjust the supply voltage at the top of the LED strings so as to achieve peak optical efficiency, while the drive circuit can operate to balance the intensities provided by the strings by varying the PWM duty cycles.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A system for exciting multiple strings of light-emitting diodes (LEDs), comprising:

a controller adapted to be coupled to at least two LED strings, each of which includes at least one LED;

at least one light intensity sensor, each of said sensors arranged to produce an output which varies with the intensity of the light output produced by at least one of said LED strings; and a current monitoring circuit connected in series with said LED strings and arranged to monitor the current conducted by each of said LED strings;

said controller arranged to receive said sensor outputs, said controller, said LED strings, and said current monitoring circuit and/or said at least one light intensity sensor forming a closed-loop feedback circuit such that said controller provides closed-loop control of the currents conducted by said LED strings by time-sequentially pulse-width modulating said currents in response to said sensor outputs one at a time such that each string conducts a desired current and/or such that desired light intensities are produced by said strings.

2. The system of claim 1, wherein each of said strings includes two or more LEDS connected in series.

3. The system of claim 1, wherein said at least two LED strings comprise a string of red LEDs, a string of green LEDs, and a string of blue LEDs.

4. The system of claim 3, wherein said at least one light intensity sensor comprises at least three light intensity sensors, each of which produces an output which varies with the intensity of the light output produced by a respective one of said LED strings.

5. The system of claim 3, wherein said at least one light intensity sensor comprises at least three light intensity sensors, each of which produces an output which varies with the intensity of the light output produced by said LED strings over a specified range of wavelengths.

6. The system of claim 1, wherein said controller is arranged to time-sequentially excite said LED strings such that the intensity of the light produced by each string is substantially equal.

7. The system of claim 1, wherein said controller is arranged to time-sequentially excite said LED strings such that the resulting light is substantially white.

8. The system of claim 1, wherein said controller is arranged to time-sequentially excite said LED strings such that said strings produce light having respective intensities which are in a desired ratio to each other.

9. The system of claim 1, wherein said controller is arranged to time-sequentially excite said LED strings such that the resulting light is maintained at a desired intensity and as a desired color.

10. The system of claim 1, wherein said at least two LED strings comprise white LEDs.

11. The system of claim 1, wherein said controller is further arranged to detect a discontinuity or a short circuit within a given LED string when exciting said string.

12. The system of claim 1, further comprising a photosensor which produces an output which varies with the intensity of the light output produced any of said LED strings, said controller further arranged to receive said photosensor output and to adjust the excitation to said LED strings as needed to achieve a desired output from said photosensor.

13. The system of claim 1, wherein said controller includes a plurality of switching transistors, each of said LED strings connected between a supply voltage and a respective one of said switching transistors, said controller arranged to time-sequentially pulse-width modulate said LED strings by operating said switching transistors.

14. The system of claim 13, wherein said controller is further arranged to provide said supply voltage, said controller arranged to operate said switching transistors so as to pulse-width modulate said string currents and to vary said supply voltage such that each of said strings conducts a desired current.

15. The system of claim 1, wherein said controller includes a color control algorithm processor arranged to receive said sensor outputs and to operate said switching transistors such that the resulting light is maintained as a desired color.

16. The system of claim 1, wherein each of said LED strings has an associated optimal current, said controller arranged to pulse-width modulate the currents conducted by said LED strings such that each string conducts an average current approximately equal to its respective optimal current.

17. The system of claim 16, wherein at least two LED strings comprises x LED strings, said controller arranged to pulse-width modulate the current conducted by each of said LED strings with a duty ratio of between 0 and 100/x %, said controller further arranged such that each of said strings conducts an average current which is equal or proportional to x times its optimal current.

18. The system of claim 17, wherein said controller is further arranged such that each of said LED strings conducts a nominal non-zero current during the 'off' portion of the string's duty cycle.

19. The system of claim 1, wherein said current monitoring circuit connected in series with said LED strings comprises a current sense resistor connected to conduct the currents conducted by each of said strings, said controller arranged to receive the voltage across said current sense resistor as a feedback signal.

20. An LCD display backlighting system, comprising:

at least two LED strings, each of which includes at least one LED;

a controller coupled to said at least two LED strings;

at least one light intensity sensor, each of said sensors arranged to produce an output which varies with the intensity of the light output produced by at least one of said LED strings; and a current monitoring circuit connected in series with said LED strings to monitor the current conducted by each of said LED strings;

said controller arranged to receive said sensor outputs, said controller, said LED strings, and said current monitoring circuit and/or said at least one light intensity sensor forming a closed-loop feedback circuit such that said controller provides closed-loop control of the currents conducted by said LED strings by time-sequentially pulse-width modulating said currents in response to said sensor outputs one at a time such that each string conducts a desired current and/or such that desired light intensities are produced by said strings.

21. The system of claim 20, wherein said at least two LED strings comprise a string of red LEDs, a string of green LEDs, and a string of blue LEDs.

22. The system of claim 21, wherein said controller is arranged to time-sequentially excite said LED strings such that the intensity of the light produced by each string is substantially equal.

23. The system of claim 21, wherein said controller is arranged to time-sequentially excite said LED strings such that the resulting light is substantially white.

24. The system of claim 20, wherein said at least two LED strings comprise a string of red LEDs, a string of green LEDs, and a string of blue LEDs;

said system further comprising at least three light intensity sensors, each of which is arranged to produce an output which varies with the intensity of the light output produced by said LED strings over a specified range of wavelengths.

* * * * *